US006336459B1

(12) United States Patent
Miyake et al.

(10) Patent No.: US 6,336,459 B1
(45) Date of Patent: Jan. 8, 2002

(54) MASK

(75) Inventors: Takao Miyake; Kaoru Miyake, both of Shizuoka (JP)

(73) Assignee: San-M Package Co., Ltd., Shizuoka-ken (JP)

( * ) Notice: Subject to any disclaimer, the term of this patent is extended or adjusted under 35 U.S.C. 154(b) by 0 days.

(21) Appl. No.: 09/642,469

(22) Filed: Aug. 21, 2000

(30) Foreign Application Priority Data

Jan. 21, 2000 (JP) ..... 12-013208
Jun. 15, 2000 (JP) ..... 12-179690

(51) Int. Cl.[7] ..... A61F 11/00
(52) U.S. Cl. ..... 128/857; 128/206.19; 2/206
(58) Field of Search ..... 128/845, 846, 128/857, 858, 206.12, 206.19; 2/9, 206, 427

(56) References Cited

U.S. PATENT DOCUMENTS 4,688,566 A * 8/1987 Boyce ..... 128/206.19
4,944,294 A * 7/1990 Borek ..... 128/206.18
5,584,078 A * 12/1996 Seboory ..... 128/857
6,173,712 B1 * 1/2001 Brunson ..... 128/201.17

* cited by examiner

*Primary Examiner*—Michael A. Brown
(74) *Attorney, Agent, or Firm*—Kanesaka & Takeuchi

(57) ABSTRACT

A mask is formed of an upper part, a lower part opposing the upper part and having a form generally similar to that of the upper part, and a connection part for connecting a lower edge of the upper part and an upper edge of the lower part. The left edges of the upper and lower parts are joined, and the right edges of the upper and lower parts are joined, while the upper edge of the upper part and the lower edge of the lower part are not joined. The connection part has a folding portion located between the upper part and the lower part, and is bent relative to the lower edge of the upper part and the upper edge of the lower part, so that the connection part does not protrude outwardly over the lower edge of the upper part and the upper edge of the lower part. Breathing can be made easily in the mask.

7 Claims, 18 Drawing Sheets

MASK

BACKGROUND OF THE INVENTION AND RELATED ART STATEMENT

The invention relates to a mask, more particularly, a mask which can be used conveniently.

Conventionally, when a mask is not used, an upper side of the mask is piled or placed over a lower side thereof to form a sheet shape, but when the mask is used, a connection part of the upper side and lower side of the mask is separated from the opposite unconnection part (Japanese Utility Model Publication (KOKAI) No. 63-84253).

When the mask as described above is used, a tip of the mask protrudes to make an user's field of vision narrower, in particular, to disturb a manual operation with the mask.

The present invention has been made to provide a mask to overcome the problem as described above. Further objects and advantages of the invention will be apparent from the following description of the invention.

SUMMARY OF THE INVENTION

In order to achieve the object as described, the mask in a first aspect is formed of an upper part having an upper edge, a lower edge, a left edge, and a right edge; a lower part having an upper edge, a lower edge, a left edge, and a right edge in the form generally the same as that of the upper part; and a connection part for connecting the lower edge of the upper part and the upper edge of the lower part. The upper part is disposed to oppose the lower part.

The connection part is bent relative to the lower edge of the upper part and the upper edge of the lower part, so that the connection part does not protrude to the outside over the lower edge of the upper part and the upper edge of the lower part. A folding part or portion is provided at the connection part to be located inward relative to the lower edge of the upper part and the upper edge of the lower part.

The upper edge of the upper part and the lower edge of the lower part, and the lower edge of the upper part and the upper edge of the lower part are not respectively joined. The left edge of the upper part and the left edge of the lower part, and the right edge of the upper part and the right edge of the lower part are respectively joined.

Moreover, in the mask of the second aspect according to the first aspect, the upper edge of the upper part is generally parallel to the lower edge of the upper part, while the left edge of the upper part and the right edge of the upper part incline and taper toward the lower edge of the upper part to form a general trapezoid with the four edges. The upper edge of the lower part is generally parallel to the lower edge of the lower part, while the left edge of the lower part and the right edge of the lower part incline and taper toward the upper edge of the lower part to form a general trapezoid with the four edges. Also, the folding part is generally parallel to the lower edge of the upper part and the upper edge of the lower part.

Further, in the mask of the third aspect according to the first aspect, the connection part is provided with an elastic member in a longitudinal form parallel to the lower edge of the upper part and the upper edge of the lower part, respectively.

In addition, in the mask in the fourth aspect according to the first aspect, the lower edge of the lower part protrudes over the upper edge of the upper part.

In the mask in the fifth aspect according to the first aspect, the lower edge of the lower part protrudes over the upper edge of the upper part, and a reinforcing member in an elongated form is provided along the protrusion. Also, first and second strings are attached to the mask. The first string has one end joined between the left edge of the upper part and the left edge of the lower part, and the other end joined between the right edge of the upper part and the right edge of the lower part. The second string has one end joined between the left edge of the protrusion and the reinforcing member, and the other end joined between the right edge of the protrusion and the reinforcing member.

DETAILED DESCRIPTION OF PREFERRED EMBODIMENTS

Now, embodiments of the mask of the present invention will be described referring to the accompanying drawings.

Figure 1:
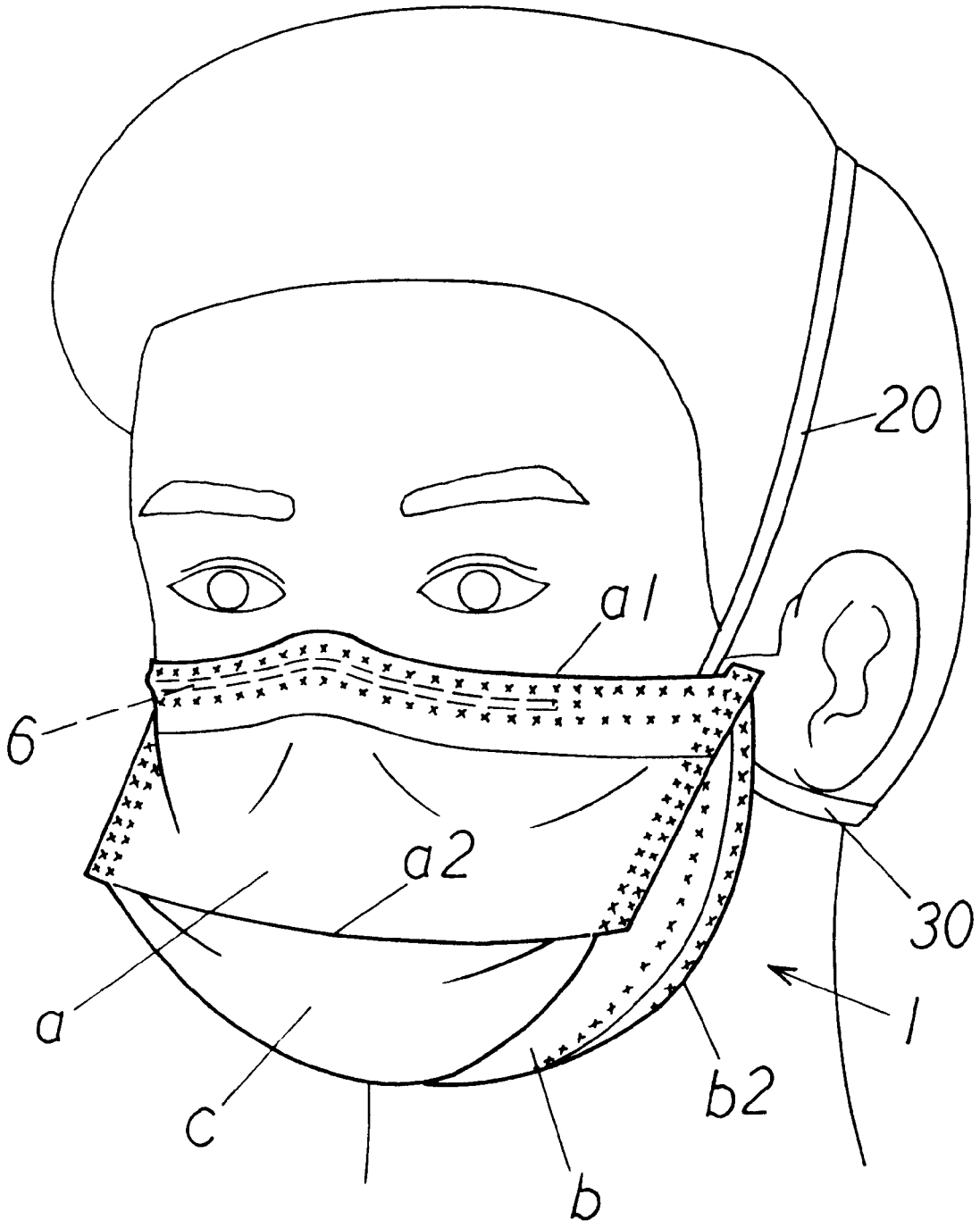
FIG. 1 is a perspective view of a mask worn by a user in the embodiment of the present invention.
Figure 2:
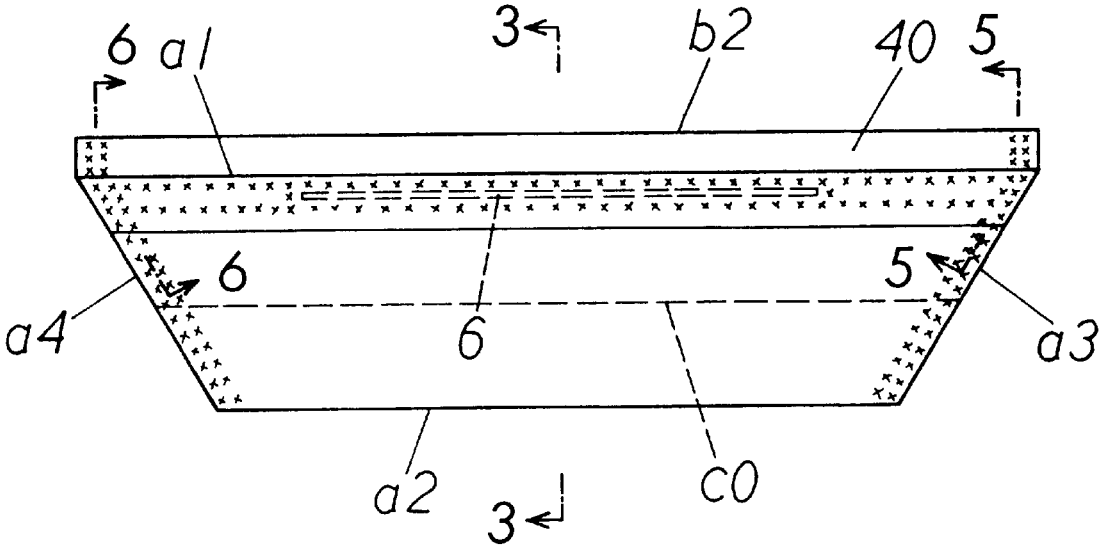
FIG. 2 is a schematic front view of the mask shown in FIG. 1.
Figure 3:
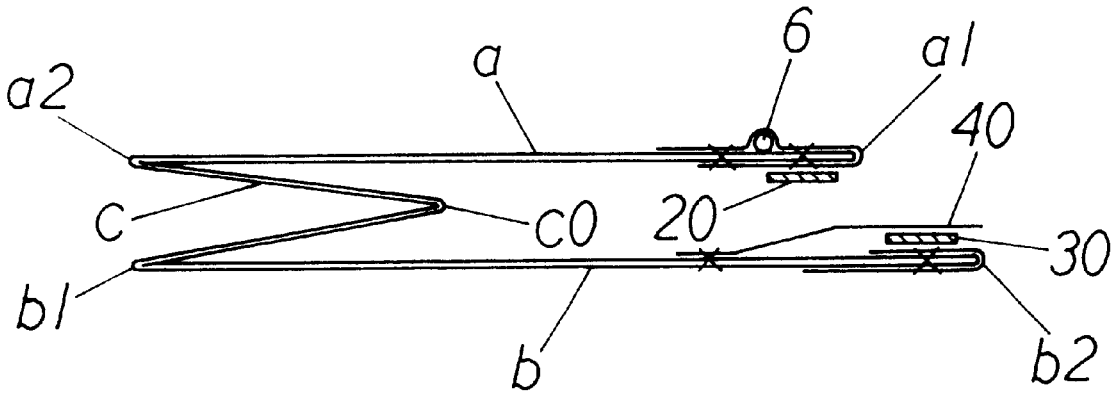
FIG. 3 is a schematic sectional view taken along line 3—3 in FIG. 2.
Figure 5:
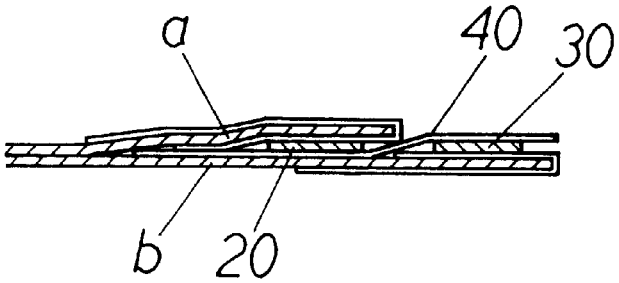
FIG. 5 is a schematic sectional view taken along line 5—5 in FIG. 2.
Figure 6:
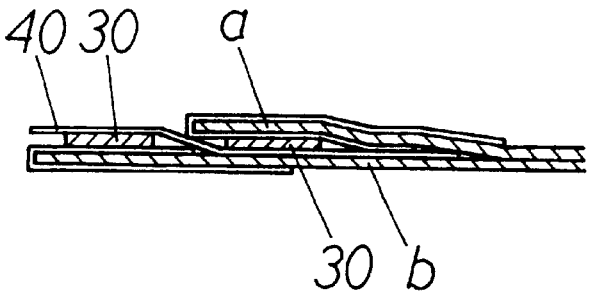
FIG. 6 is a schematic sectional view taken along line 6—6 in FIG. 2.
Figure 7:
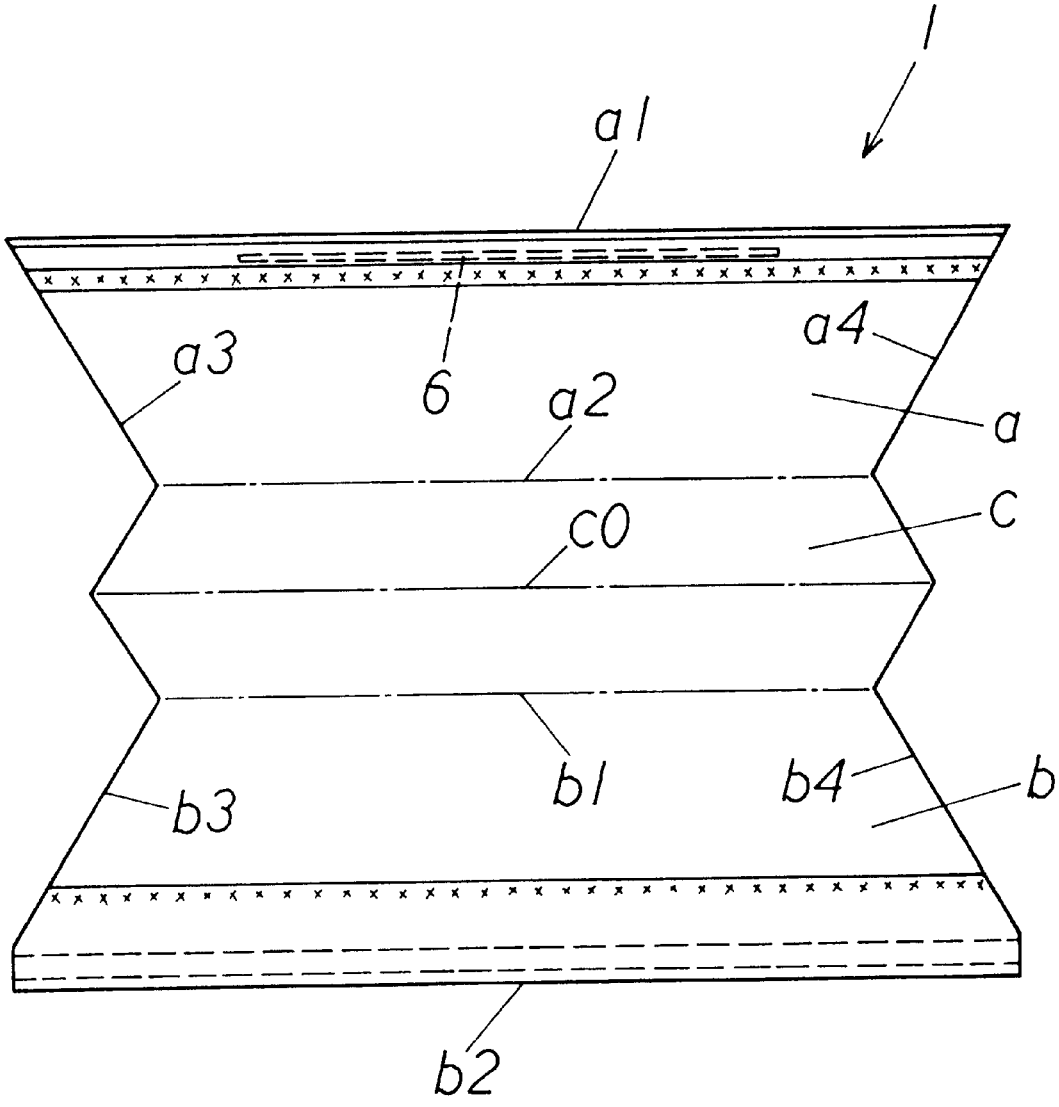
FIG. 7 is a schematic expanded view of the mask in FIG. 2.

In FIG. 1 through FIG. 7, numeral 1 designates a mask, and the mask 1 is generally made from an upper part a, a lower part b in generally the same form as that of the upper part a, and a connection part c which connects the upper part a and the lower part b (see FIGS. 1, 3 and 7).

The upper part a comprises of an upper edge a1, a lower edge a2, a left edge a3, and a right edge a4, as shown in FIG. 7. For example, in the upper part, the upper edge a1 is preferably parallel to the lower edge a2, and the left edge a3 and the right edge a4 incline and taper toward the lower edge a2 to form a trapezoid with the four edges. Numeral 6 designates a nose clamp which is located within the upper part a of the mask 1, and is formed with a deformable component to easily fit an individual shape, like nose shape.

The lower part b has generally the same shape as that of the upper part a and, for example, comprises an upper edge b1, a lower edge b2, a left edge b3, and a right edge b4. In the lower part b, the upper edge b1 is preferably parallel to the lower edge b2, and the left edge b3 and the right edge b4 incline and taper toward the upper edge b1 to form a trapezoid with the four edges.

As shown in FIG. 2, the lower edge b2 of the lower part b protrudes outwardly over the upper edge a1 of the upper part a. As shown in FIG. 1, when the mask is worn, the lower edge b2 of the lower part b protrudes outwardly over the upper edge a1 of the upper edge a, so that the lower part b is supported deeply at the chin and the lower part b is prevented from leaving from the chin.

As shown in FIG. 3, the connection part C is to connect the lower edge a2 of the upper part a with the upper edge b1 of the lower part b. The upper part a opposes the lower part b, and the lower edge a2 of the upper part a and the upper edge b1 of the lower part b are bent, so that the connection part c does not protrude outwardly beyond the lower edge a2 of the upper part a and the upper edge b1 of the lower part b. The folding part CO, which is located inward relative to the lower edge a2 of the upper part a and the upper edge b1 of the lower part b and is folded, is provided at the connection part C. The folding part CO is generally parallel to the lower edge a2 of the upper part a and the upper edge b1 of the lower part b.

Although the upper edge a1 of the upper part a and the lower edge b2 of the lower part b, and the lower part a2 of the upper part a and the upper part b1 of the lower part b are not joined respectively, the left edge a3 of the upper part a is joined to the left edge b3 of the lower part b, while the right edge a4 of the upper part a is joined to the right edge b4 of the lower part b. These portions are joined together by, for example, ultrasonic bonding. In FIG. 2, the mark X shows a joined point.

Figure 4:
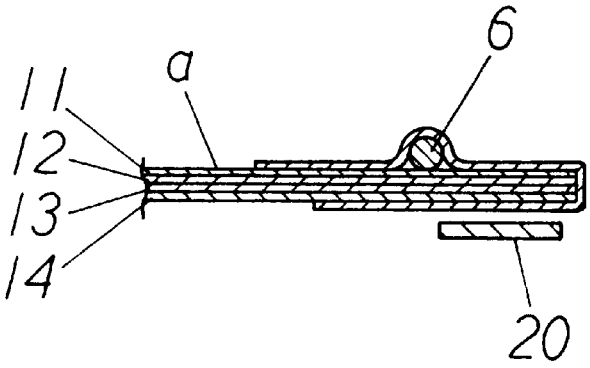
FIG. 4 is a partially enlarged schematic view of a part of FIG. 3.

As shown in FIG. 4, for example, the mask 1 is composed of four layers, a front cover 11, a first filter 12, a second filter 13, and a back cover 14, all of which are made of breathable materials, and numeral 20 designates a first elastic strand, while numeral 30 designates a second elastic strand. As shown in FIG. 1, the first strand 20 and the second strand 30 are placed over the head of a user to fix the mask 1 to a desired position.

One end of the first strand 20 is joined between the left edge a3 of the upper part a and the left edge b3 of the lower part b, and the other end of the first strand 20 is joined between the right edge a4 of the upper part a and the right edge b4 of the lower part b, by ultrasonic bonding, for example (See FIGS. 2, 5 and 6).

The term "join" is used not only when one end of the first strand 20 is directly joined between the left edge a3 of the upper part a and the left edge b3 of the lower part b, while the other end of the first strand 20 is directly joined between the right edge a4 of the upper part a and the right edge b4 of the lower part b, as shown in FIG. 5 and FIG. 6, but also when the strand 20 is joined through a reinforcing member 40 described later.

As described above, the lower edge b2 of the lower part b of the mask 1 protrudes outwardly over the upper edge a1 of the upper part a, and a reinforcing member 40 is provided along the longitudinal direction of the protrusion. One end of the second strand 30 is joined between the left edge of the protrusion of the lower part b of the mask 1 and the reinforcing member 40, and the other end of the second strand 30 is joined between the right edge of the protrusion of the lower part b of the mask 1 and the reinforcing member 40 by, for example, supersonic bonding respectively (See. FIGS. 2, 5 and 6).

Thus, one end of the second strand 30 is connected between the left edge of the protrusion of the lower part b of the mask 1 and reinforcing member 40, and the other end of the second strand 30 is connected between the right edge of the protrusion of the lower part b of the mask 1 and reinforcing member 40, respectively. Thus, the strength of the connection part of the second strand 30 can be improved because of the reinforcing member 40.

When the mask 1 is not used, the folding part Co is turned or folded, as shown in FIG. 3. When the mask is used, as the connection part C having the folding part Co is stretched, the user does not feel difficulty in breathing, and the area for breathing can be enlarged. In addition, the connection part of the left edge a3 of the upper part a and the left edge b3 of the lower part b, and the connection part of the right edge a4 of the upper part a and the right edge b4 of the lower part b, do not so much protrude over the upper edge a1 of the upper part a and the lower edge b2 of the lower part b, so that the user can obtain a good visual field when the mask 1 is worn, and the usability can be improved.

Figure 8:
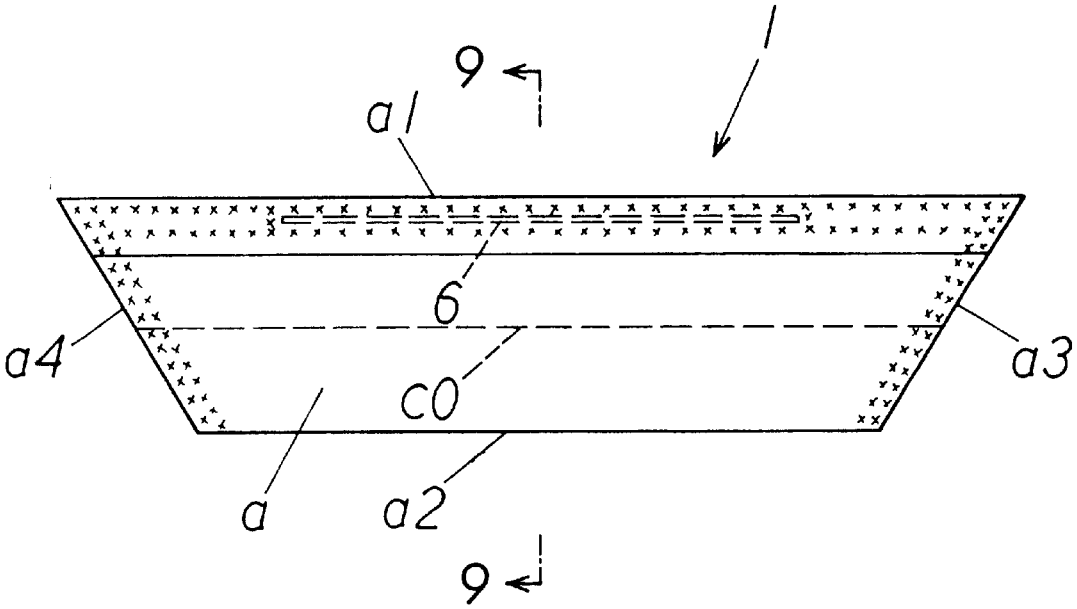
FIG. 8 is a front view of another embodiment of a mask.
Figure 10:
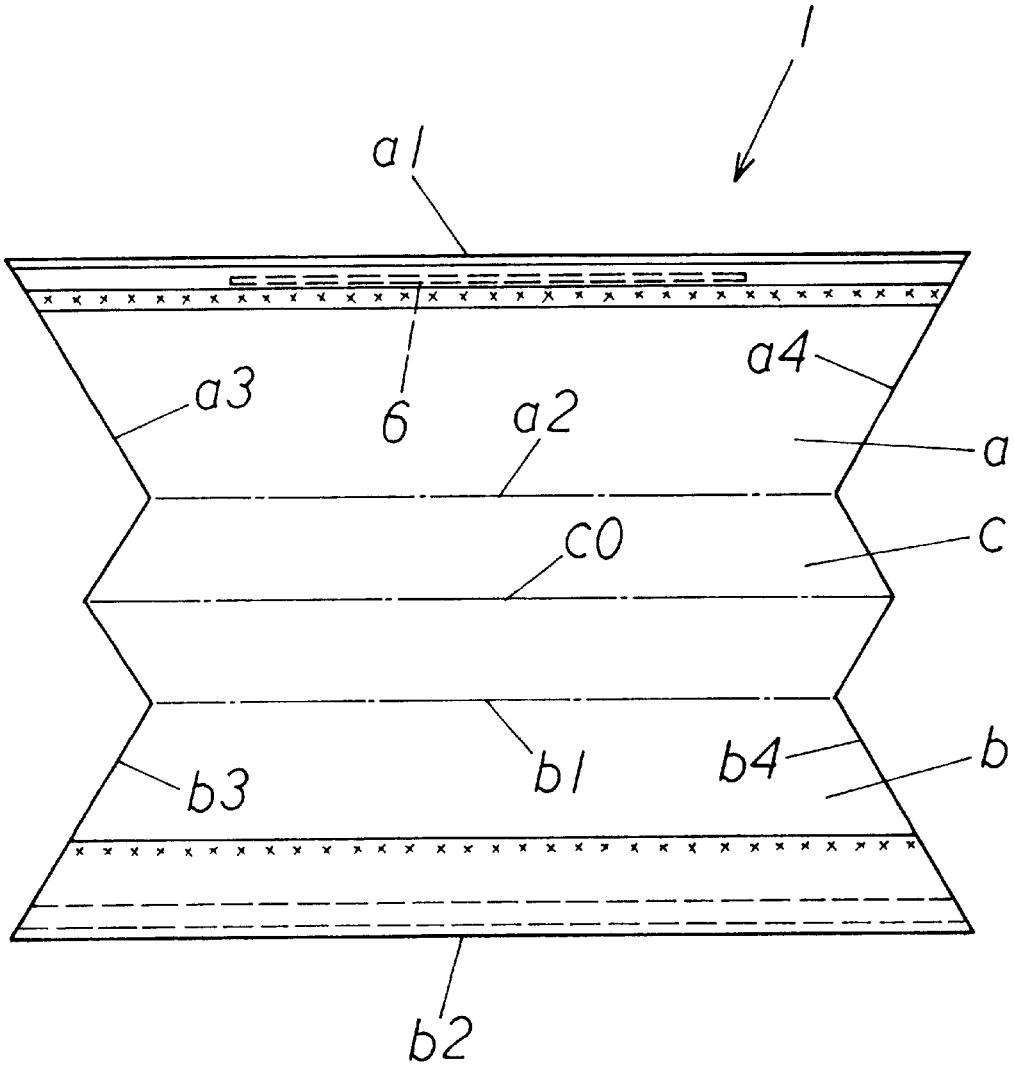
FIG. 10 is a schematic expanded view of the mask in FIG. 8.
Figure 11:
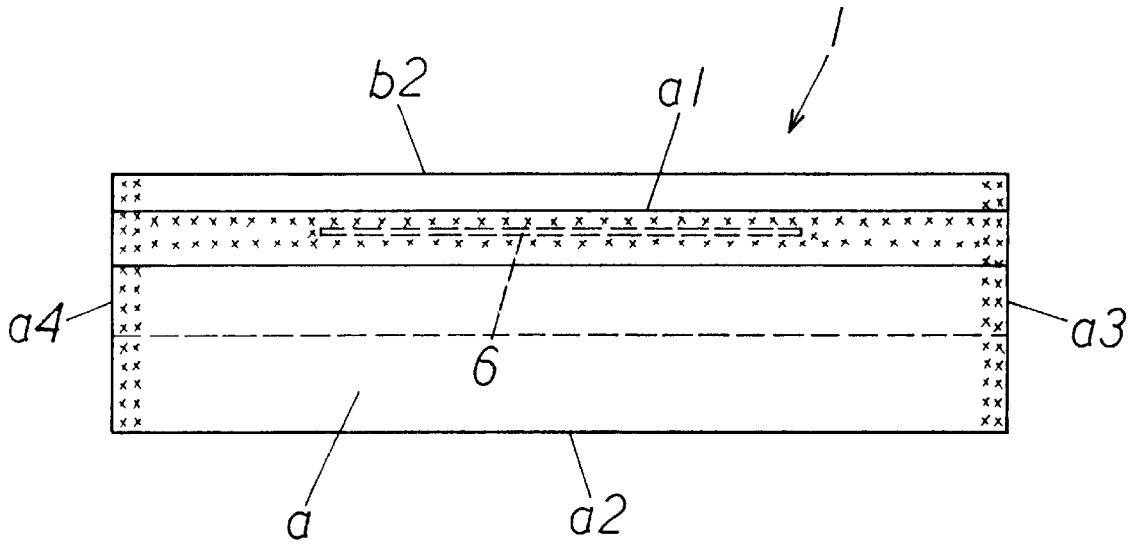
FIG. 11 is a front view of a mask of still another embodiment of the invention.

In the embodiment as described above (see FIGS. 2 and 3), the lower edge b2 of the lower part b protrudes outwardly over the upper edge a1 of the upper part a. But, the present invention is not limited to this embodiment. As shown in FIG. 8 and FIG. 10, for example, the lower edge b2 of the lower part b can be made to correspond to the upper edge a1 of the upper part a, so that the lower edge b2 of the lower part b may not protrude outwardly over the upper edge a1 of the upper part a.

In the embodiment as described in FIG. 7 and FIG. 10, the upper part a and the lower part b are generally trapezoidal respectively, but the present invention is not limited to the shape, and the upper part a may be a general rectangle shape formed of the upper edge a1, the lower edge a2, the left edge a3 and the right edge a4, for example, while the lower part (not shown) may have the same general rectangle shape.

Figure 12:
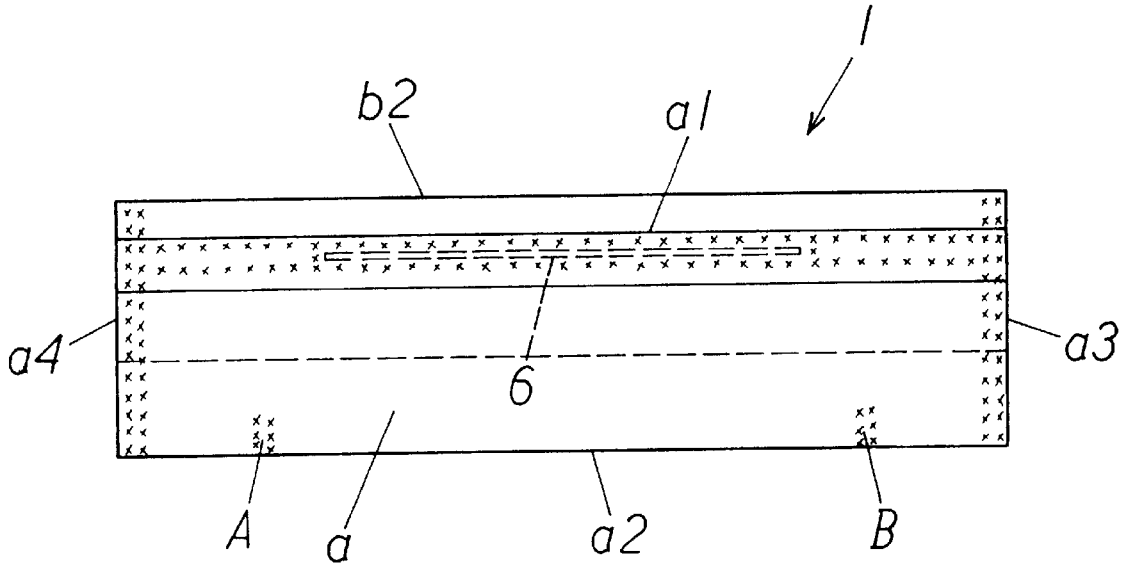
FIG. 12 is a front view of a mask of still another embodiment of the invention.

In this case, as shown in FIG. 12, the lower side of the upper part a and the upper side of the lower part (not shown) can be joined by supersonic welding, for example. In FIG. 12, the marks A and B show joined points.

In a mask 1 shown in FIG. 13 through FIG. 17, numeral 10 is an elastic member in a longitudinal shape. The elastic member 10 is provided at the connection part C, preferably parallel to the lower edge a2 of the upper part a and the upper part b1 of the lower edge b, located within the mask 1, and positioned by welding the periphery of the elastic member 10 by supersonic welding.

Figure 13:
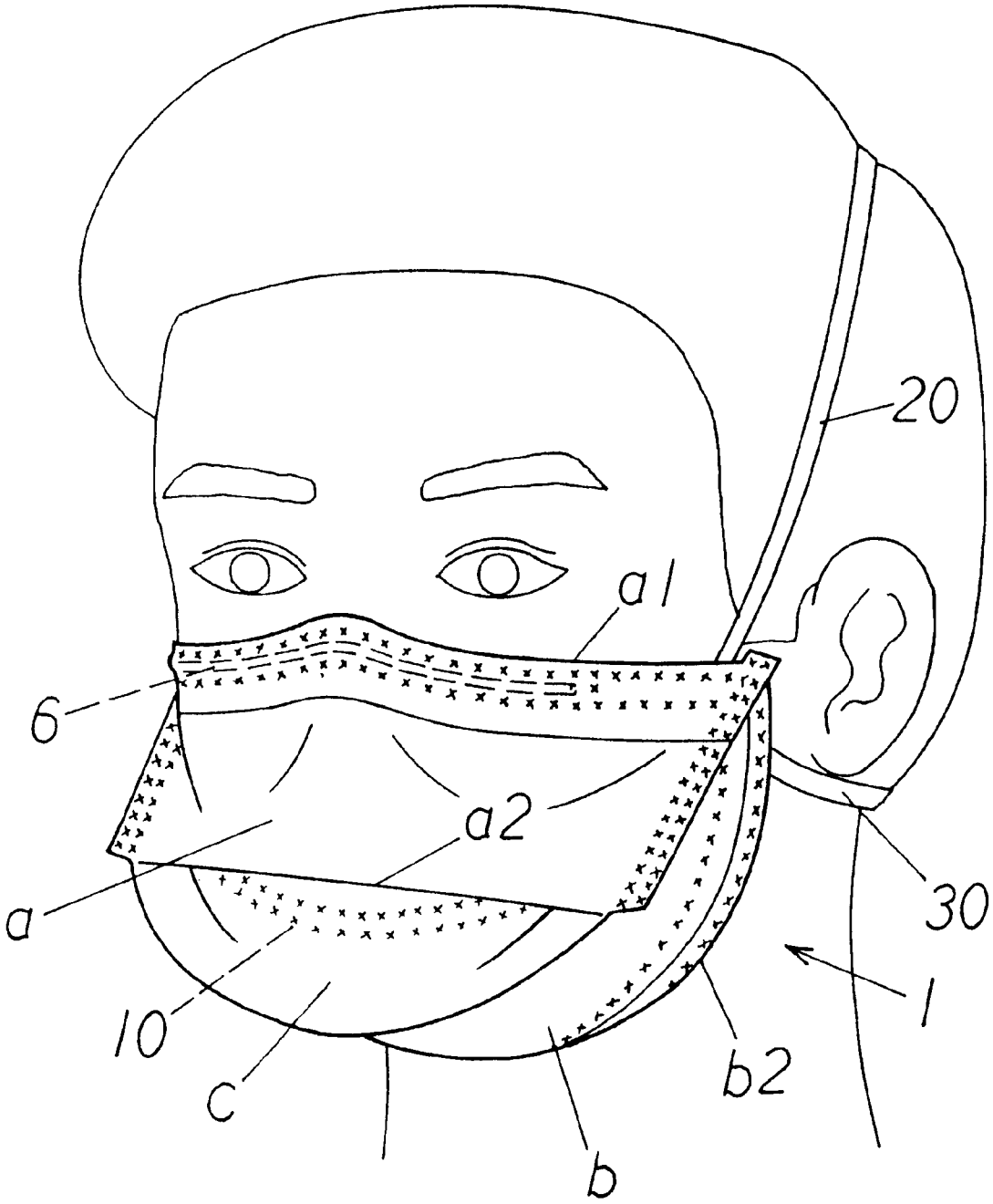
FIG. 13 is a perspective view of a mask in use showing still another embodiment of the invention.
Figure 14:
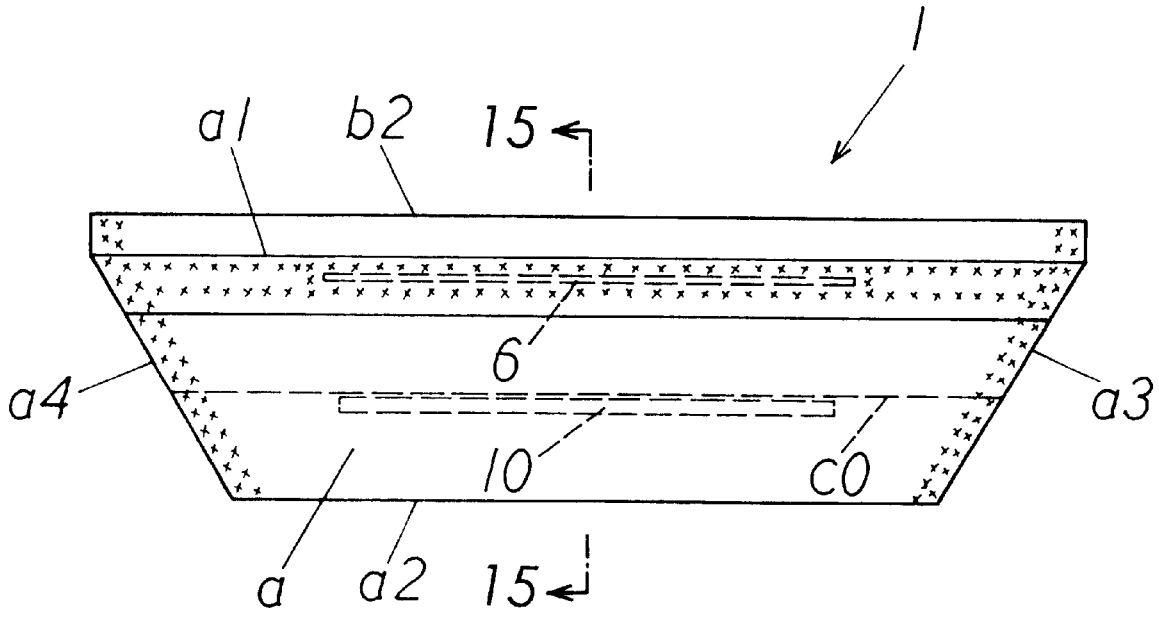
FIG. 14 is a schematic front view of the mask in FIG. 13 when the mask is not used.
Figure 15:
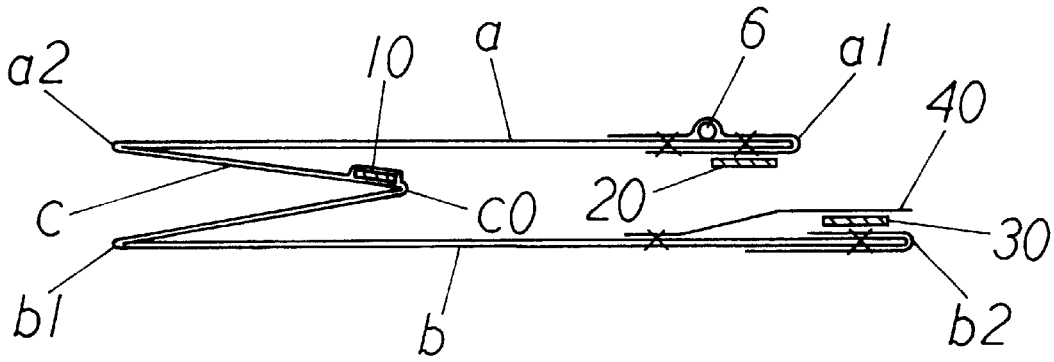
FIG. 15 is a sectional view taken along line 15—15 in FIG. 14.
Figure 16:
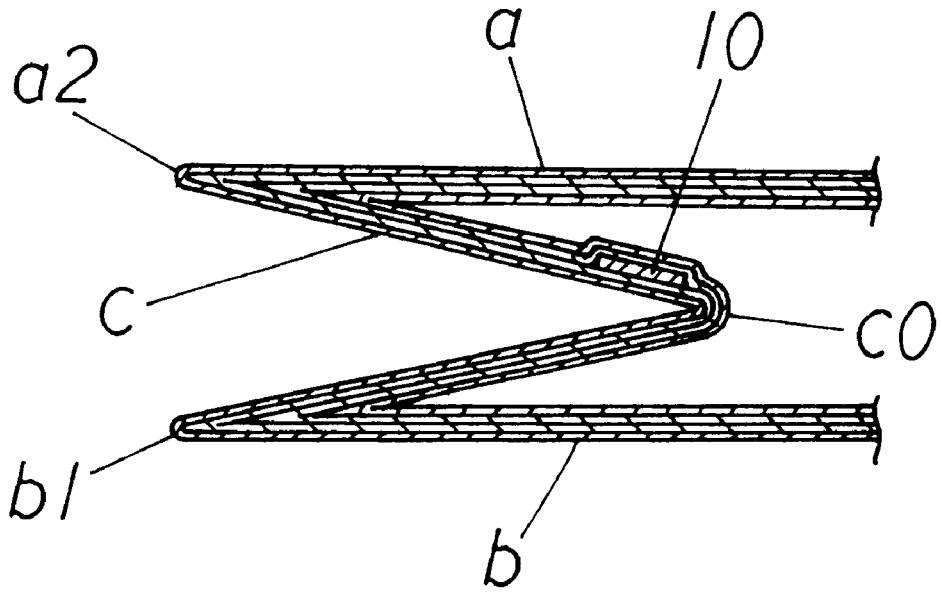
FIG. 16 is a partially enlarged view of a part of FIG. 15.
Figure 17:
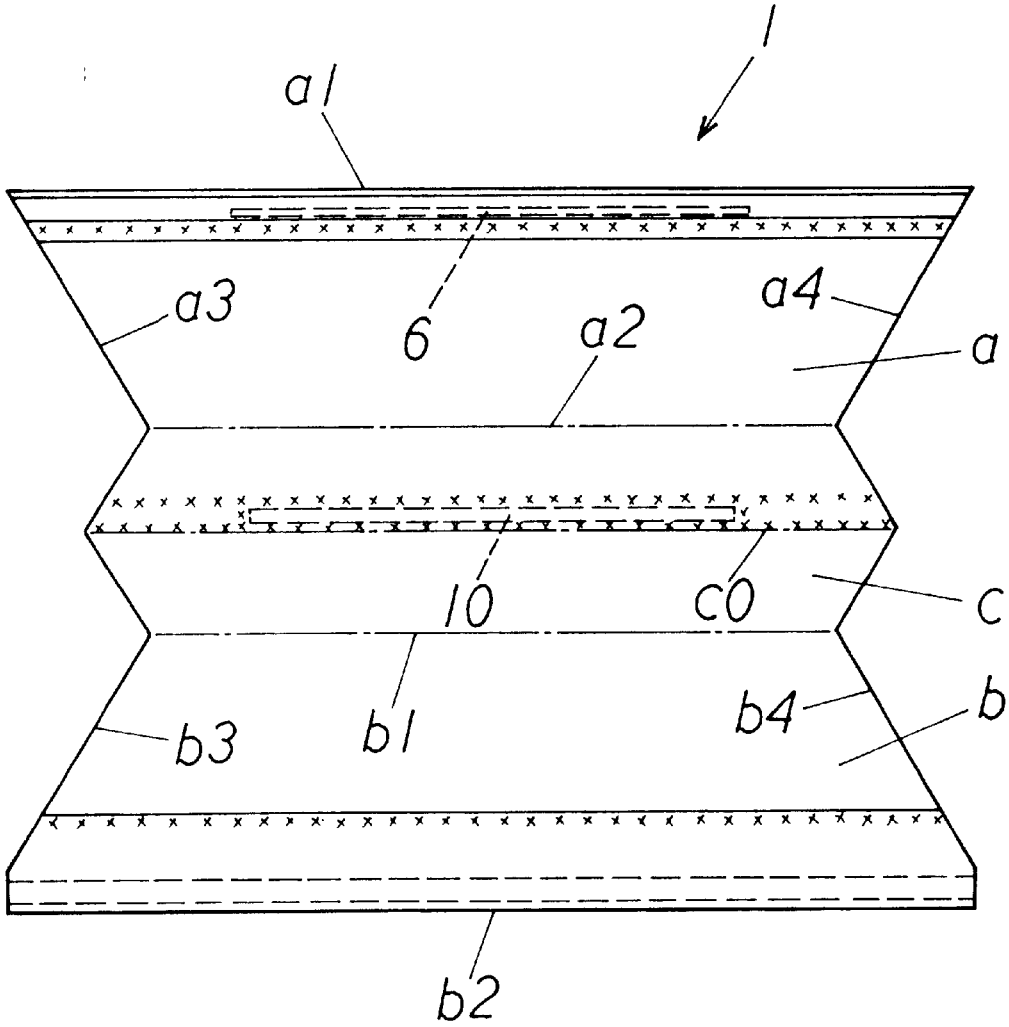
FIG. 17 is a schematic expanded view of the mask in FIG. 14.

When the upper edge a1 of the upper part a and the lower edge b2 of the lower part b2 are separated, as shown in FIG. 13, from the sheet form in which the upper part a is laid over the lower part b in the mask 1 as shown in FIG. 14, the elastic part 10 can be made into a convex shape to enlarge outwardly the connection part C having the folding part Co, so that the interval between the connection part c and the mouth is maintained to prevent the mouth from contacting the connection part C.

The mask 1 in FIG. 13 through FIG. 17 is the same as the mask 1 in the FIG. 1 through FIG. 7, except for the elastic member 10, so that the same numerals are designated to the similar parts and the description of the parts are omitted.

Figure 9:
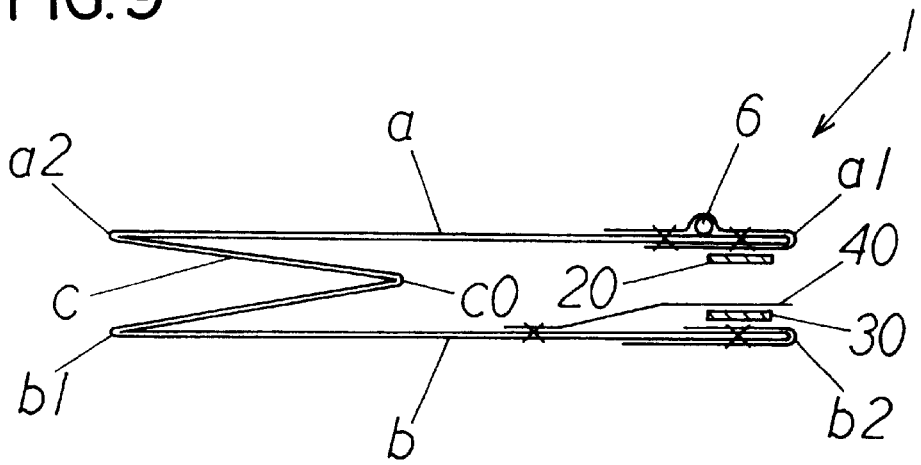
FIG. 9 is a schematic sectional view taken along line 9—9 in FIG. 8.
Figure 19:
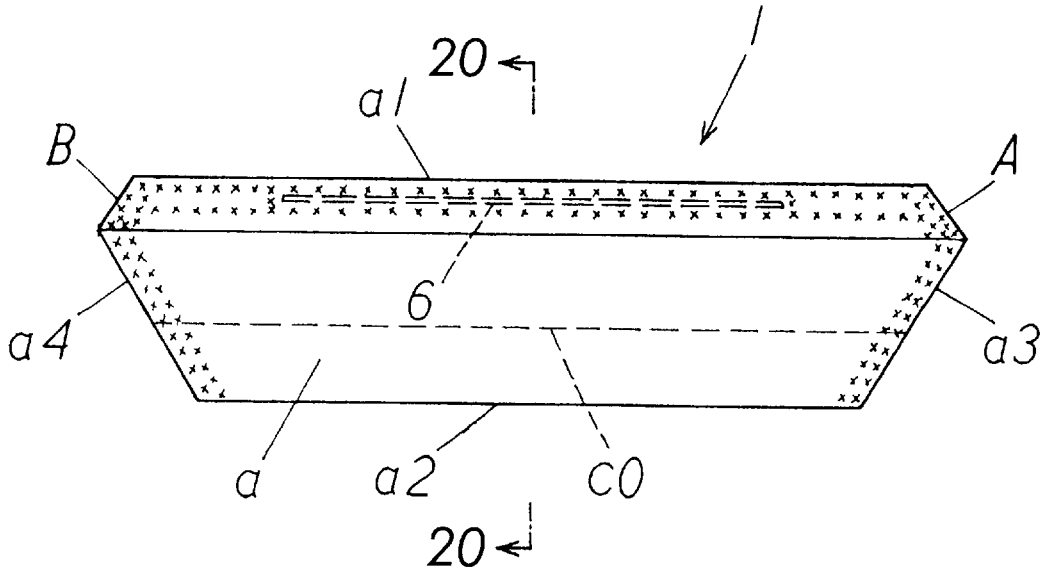
FIG. 19 is a schematic front view of the mask in FIG. 18.
Figure 20:
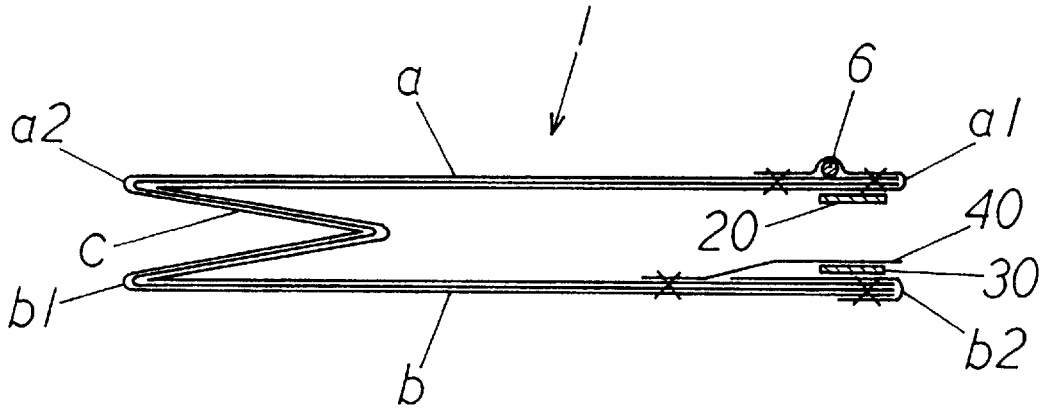
FIG. 20 is a schematic sectional view taken along line 20—20 in FIG. 19.
Figure 21:
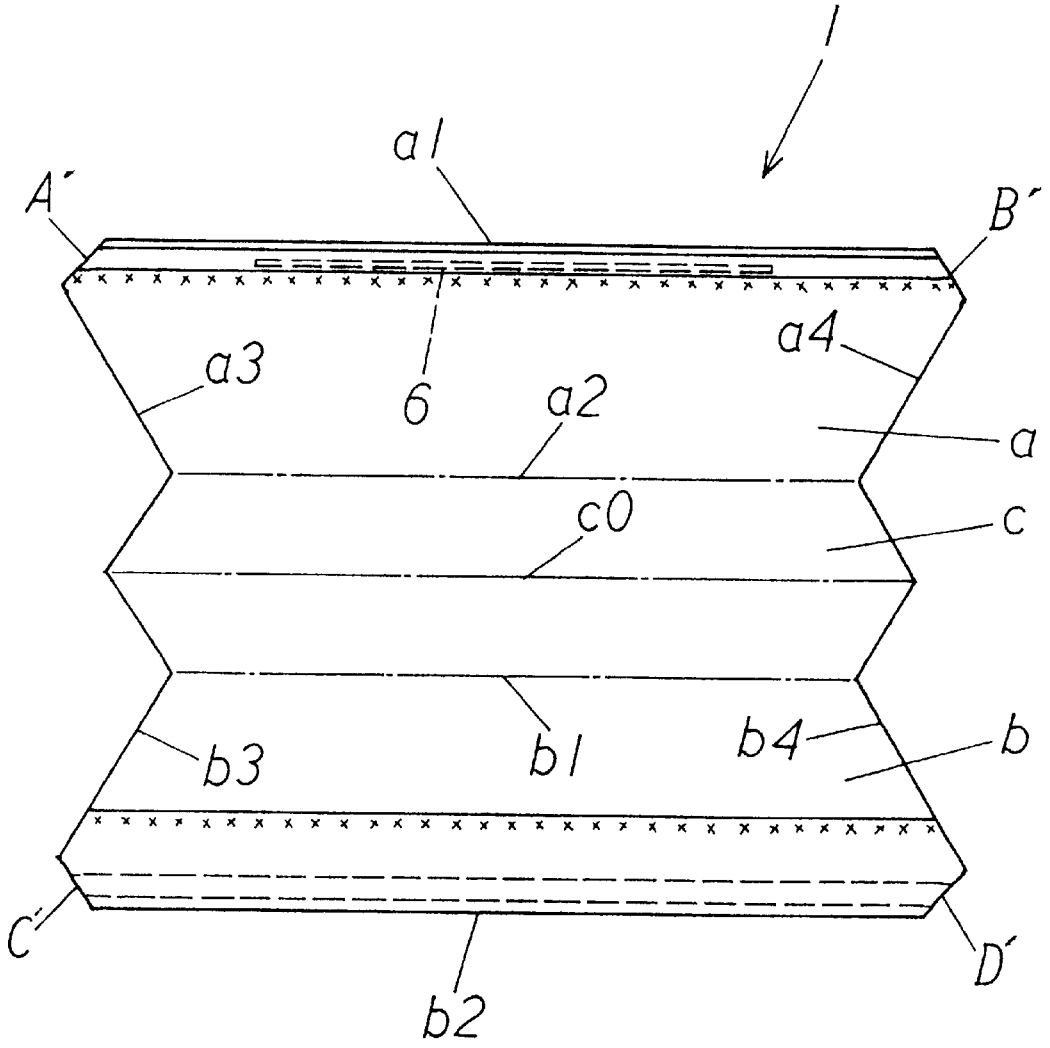
FIG. 21 is a schematic expanded view of the mask in FIG. 18.

The mask 1 shown in FIG. 18 through FIG. 21 is the same as the mask 1 in the FIG. 8 through FIG. 10, except that a part A' in FIG. 21 where the left edge a3 of the upper part a extends to the upper edge a1 and a part B' in FIG. 21 where the right part a4 of the upper part a extends to the upper edge a1, incline and taper toward the upper edge a1; that a part C' in FIG. 21 where the left edge b3 of the lower edge b extends to the lower edge b2 and a part D' in FIG. 21 where the right part b4 of the lower edge b extends to the lower edge b2, incline and taper toward the lower edge b2; and that the parts A' and C' opposite to each other and the parts B' and D' opposite to each other are not joined respectively. Therefore, the same numerals are designated to the similar parts and the description of the parts are omitted.

In particular, the part A' where the left edge a3 of the upper part a continues to the upper edge a1, and the part B' where the right part a4 of the upper part a continues to the upper edge a1, incline and taper toward the upper edge a1. The part C' where the left edge b3 of the lower part b continues to the lower edge b2, and the part D' where the right part b4 of the lower part b continues to the lower edge b2, incline and taper toward the lower edge b2. Also, the parts A' and C' opposite to each other and the parts B' and D' opposite to each other are not joined, respectively. Thus, when the mask 1 is worn, the contact area of the upper part edge a1 and the lower edge b2 on the face is increased to improve the fitness. As the holding position of the first strand 20 and the second strand become flat, the fitness is improved. The number of the layers of unwoven fabrics in the attachment part of the first strand 20 and the second strand 30 is decreased, so that the mask is not stiff and its fitness is improved. As the reinforcing member 40 is interposed between the first strand 20 and the second strand 30, the first strand 20 and the second strand 30 are prevented from sticking to each other, while the first strand 20 is easily identified from the second strand 30 (for example, the upper side a is set upward, and the lower side b is set downward). Also, the second strand 30 is located between the reinforcing member 40 and the lower edge 2, and welded in the sandwiching condition, so that the strength of the second strand can be improved.

Figure 22:
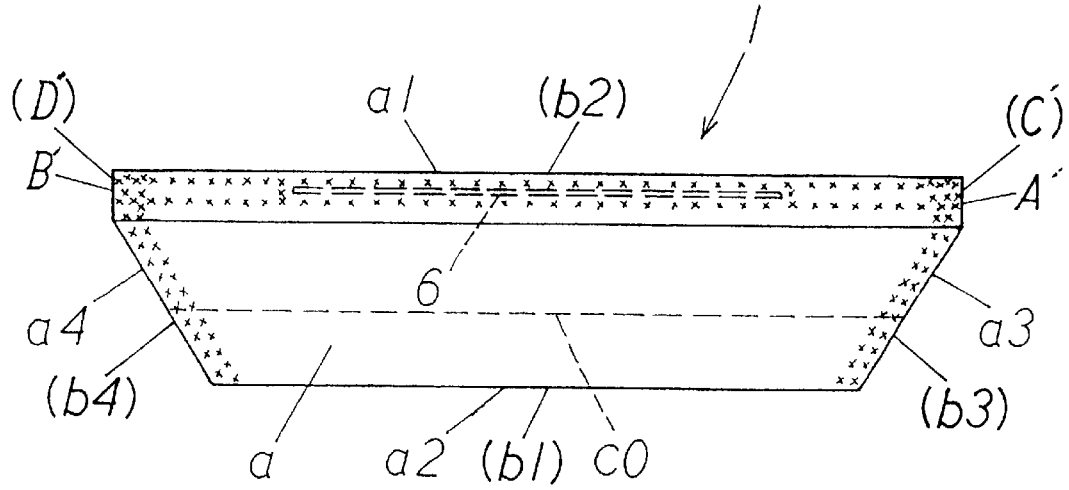
FIG. 22 is a schematic front view of still another embodiment of the invention.

In the mask 1 shown in FIG. 18 through FIG. 21, the part A' where the left edge a3 of the upper part a continues to the upper edge a1, and the part B' where the right part a4 of the upper part a continues to the upper edge a1, incline and taper toward the upper edge a1. The part C' where the left edge b3 of the lower part b continues to the lower edge b2, and the part D' where the right part b4 of the lower part b continues to the lower edge b2, incline and taper toward the lower edge b2. However, a part A' in FIG. 22 where the left edge a3 of the upper part a continues to the upper edge a1, and a part B' in FIG. 22 where the right edge a4 of the upper part a continues to the upper edge a1, can intersect the upper edge a1 at a generally right angle. Also, a part C' in FIG. 22 where the left edge b3 of the lower part continues to the upper edge b2, and a part D' in FIG. 22 where the right edge b4 of the lower part continues to the lower edge b2, can intersect the upper edge b2 at a generally right angle. In this case, similar to the mask 1 in FIGS. 18 through 21, the parts A' and C' opposite to each other and the parts B' and D' opposite to each other are not joined respectively.

Figure 18:
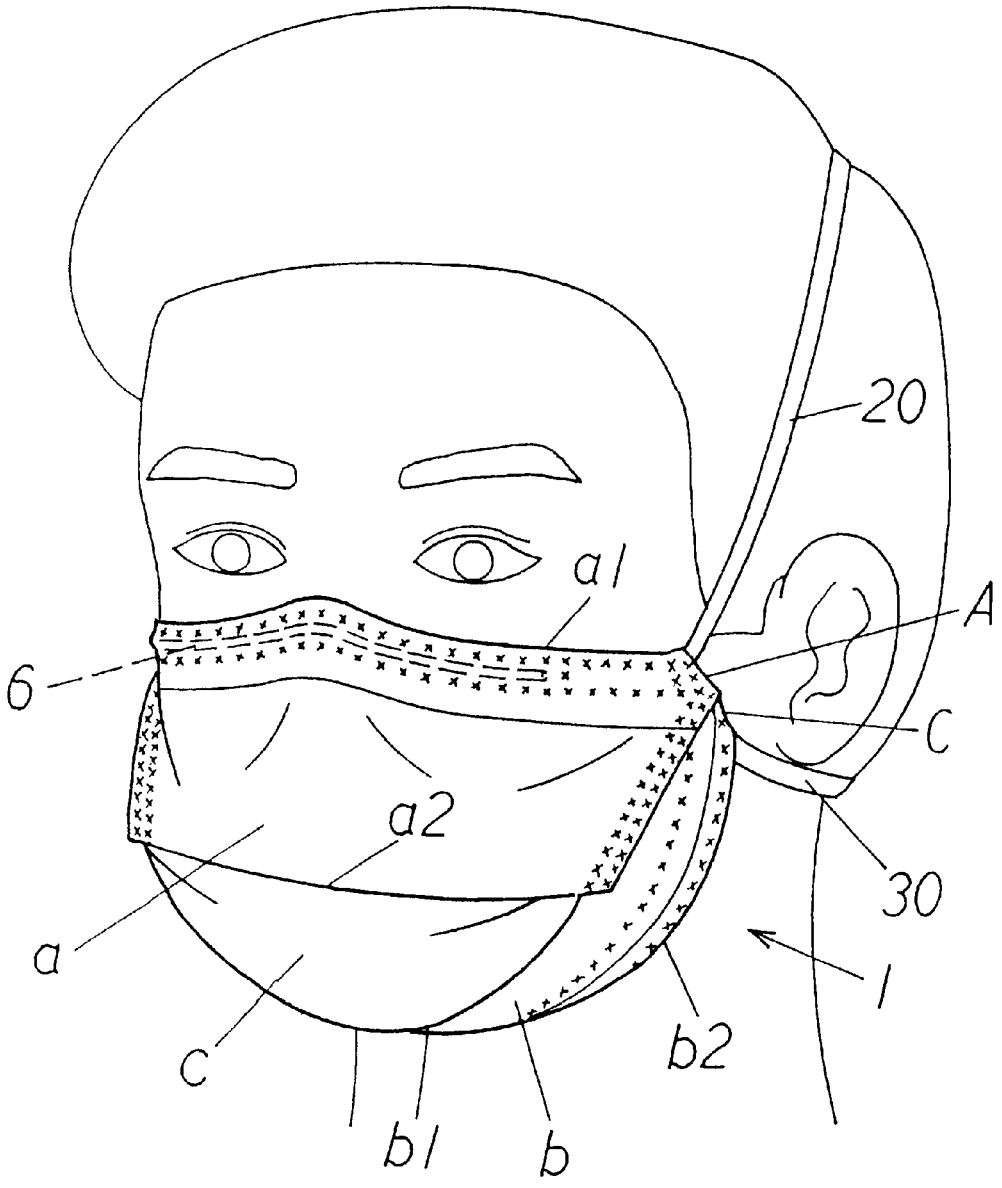
FIG. 18 is a perspective view of a mask in use showing still another embodiment of the invention.
Figure 23:
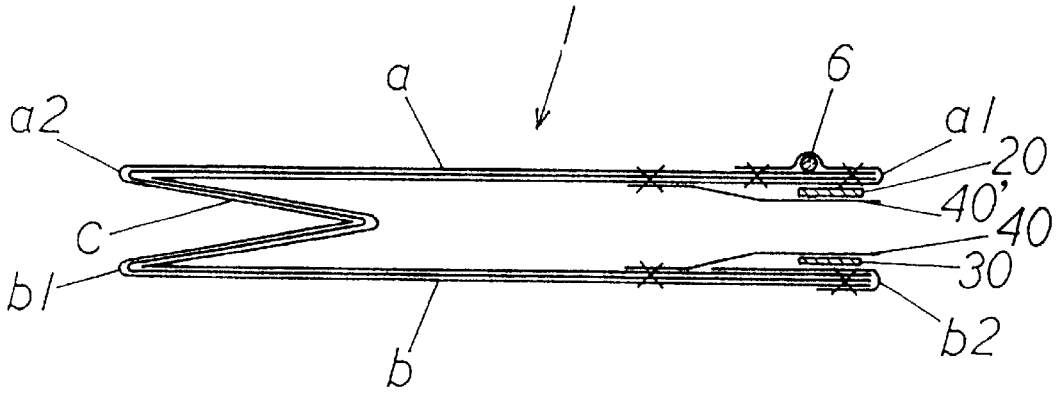
FIG. 23 is a schematic sectional view of still another embodiment of the invention.

In the mask 1 of FIG. 18 through FIG. 20, the second strand 30 is located between the reinforcing member 40 and the lower edge b2, and is kept sandwiched (See FIG. 20), though the reinforcing member 40 is not provided for the first strand 20. However, as shown in FIG. 23, the first strand 20 can be located between a reinforcing member 40' and the upper edge a1, and can be welded so as to be kept sandwiched therebetween to improve the welding strength of the first strand 20.

According to the mask 1 in the first and second aspects, when the mask 1 is used, as the connection part C having the folding portion Co is expanded, the user does not feel difficult in breathing, and the area for breathing can be enlarged.

Moreover, the connection part of the left edge of the upper part and the left edge of the lower part, and the connection part of the right edge of the upper part and the right edge of the lower part do not protrude so much over the upper edge of the upper part and the lower edge of the lower part, so that the user can obtain a good visual field when the mask is worn, and the usability can be improved.

According to the mask in the third aspect, in addition to the effect in the first aspect as described above, when the upper edge of the upper part and the lower edge of the lower part are greatly separated, the elastic part can form a convex shape in the outward direction such that the connection part having the folding part is enlarged. Thus, the interval between the connection part and the mouth is maintained to prevent the mouth from contacting the connection part.

According to the fourth aspect, in addition to the effect of the first aspect, the lower edge of the lower part can be deeply engaged with a chin to the extent that the lower edge of the lower part protrudes outwardly over the upper edge of the upper part, so that the lower part can be prevented from leaving from the chin even when the mouth is opened.

According to the mask in the fifth aspect, in addition to the effect of the first aspect, the lower part can be deeply engaged with a chin to the extent that the lower edge of the lower part protrudes outwardly over the upper edge of the upper side. Therefore, even when the mouth is opened, the lower part is still engaged with chin. Also, since one end of the second strand is joined between the left side of the protrusion and the reinforcing member, and the other end of the second strand is joined between the right edge of the protrusion and the reinforcing member, the strength of the connection of the second strand can be improved, because of the reinforcing member.

While the invention has been explained with reference to the specific embodiments of the invention, the explanation is illustrative and the invention is limited only by the appended claims.

What is claimed is:

1. A mask comprising:

an upper part having an upper edge, a lower edge, a left edge, and a right edge, a lower part opposing the upper part and having an upper edge, a lower edge, a left edge, and a right edge in a form generally similar to that of the upper part, said left edges of the upper and lower parts being joined together along the same and said right edges of the upper and lower parts being joined together along the same while the upper edge of the upper part and the lower edge of the lower part are not joined, and a connection part for connecting the lower edge of the upper part and the upper edge of the lower part, said connection part having a folding portion located between the upper part and the lower part and being bent relative to the lower edge of the upper part and the upper edge of the lower part so that the connection part does not substantially protrude outwardly over the lower edge of the upper part and the upper edge of the lower part, said folding portion having right and left edges integrally joined to the right and left edges of the upper and lower parts along the same, respectively.

2. A mask according to claim 1, wherein the upper edge of the upper part is generally parallel to the lower edge of the upper part, while the left edge of the upper part and the right edge of the upper part incline and taper toward the lower edge of the upper part to form a general trapezoid with the four edges; the upper edge of the lower part is generally parallel to the lower edge of the lower part, while the left edge of the lower part and the right edge of the lower part incline and taper toward the upper edge of the lower part to form a general trapezoid with the four edges; and the folding portion is generally parallel to the lower edge of the upper part and the upper edge of the lower part.

3. A mask according to claim 1, wherein the connection part includes an elongated elastic member situated parallel to the lower edge of the upper part and the upper edge of the lower part respectively.

4. A mask according to claim 1, wherein the lower edge of the lower part protrudes outwardly over the upper edge of the upper part to form a protruding portion.

5. A mask according to claim 4, further comprising:

a first string having one end joined between the left edges of the upper and lower parts, and the other end joined between the right edges of the upper and lower parts, an elongated reinforcing member situated over the protruding portion, and a second string having one end joined between a left edge of the protruding portion and the reinforcing member, and the other end joined between a right edge of the protruding portion and the reinforcing member.

6. A mask according to claim 1, wherein said upper part, lower part and connection part are formed of one sheet member, said connection part being bent inwardly between the upper and lower parts when the mask is folded.

7. A mask according to claim 1, wherein said right and left edges of the folding portion are sandwiched between the right and left edges of the upper and lower pars, respectively, and joined together such that the right and left edges of the upper and lower parts are not separated along the edges thereof.

* * * * *